US007635820B2

(12) United States Patent
Shen et al.

(10) Patent No.: US 7,635,820 B2
(45) Date of Patent: Dec. 22, 2009

(54) KEY SWITCH SYSTEM HAVING INDICATOR LAMP AND FLAT PANEL DISPLAY USING SAME

(75) Inventors: Rui-Ye Shen, Shenzhen (CN); Su-Sheng Mong, Miao-Li (TW); Te-Hsu Wang, Miao-Li (TW)

(73) Assignees: Innocom Technology (Shenzhen) Co., Ltd., Shenzhen, Guangdong Province (CN); Innolux Display Corp., Miao-Li County (TW)

( * ) Notice: Subject to any disclaimer, the term of this patent is extended or adjusted under 35 U.S.C. 154(b) by 49 days.

(21) Appl. No.: 11/999,238

(22) Filed: Dec. 3, 2007

(65) Prior Publication Data

US 2008/0128250 A1 Jun. 5, 2008

(30) Foreign Application Priority Data

Dec. 1, 2006 (TW) ..... 95144726 A

(51) Int. Cl.
*H01H 9/00* (2006.01)

(52) U.S. Cl. ..... 200/314

(58) Field of Classification Search ..... 200/314, 200/296, 310–313

See application file for complete search history.

(56) References Cited

U.S. PATENT DOCUMENTS

| | | | | |
|---|---|---|---|---|
| 3,855,439 | A * | 12/1974 | Hermann | 200/524 |
| 5,134,505 | A | 7/1992 | Tanaka et al. | |
| 5,635,927 | A * | 6/1997 | Lin | 341/22 |
| 6,365,855 | B1 * | 4/2002 | Sutter et al. | 200/314 |
| 7,230,196 | B2 * | 6/2007 | Toyama, Yasunori | 200/314 |
| 7,411,142 | B2 * | 8/2008 | Jung et al. | 200/314 |
| 2003/0103359 | A1 * | 6/2003 | Chiang et al. | 362/558 |
| 2005/0217986 | A1 * | 10/2005 | Nam | 200/516 |
| 2007/0013664 | A1 * | 1/2007 | Lee et al. | 345/168 |
| 2007/0235306 | A1 * | 10/2007 | Chiba et al. | 200/314 |

* cited by examiner

*Primary Examiner*—Gary F. Paumen
(74) *Attorney, Agent, or Firm*—Wei Te Chung

(57) ABSTRACT

An exemplary key switch system (23) includes a key switch (292), an indicator lamp (29), and a light guide portion (279). The indicator lamp is configured for indicating a working status of the key switch, and emits light beams when the key switch is switched on. The light guide portion is configured for adjusting optical paths of the light beams. Most of the light beams emitted by the indicator lamp are converged by and reflected in the light guide portion and thereupon emit from the key switch system. A flat panel display (200) using the key switch system is also provided.

20 Claims, 7 Drawing Sheets

KEY SWITCH SYSTEM HAVING INDICATOR LAMP AND FLAT PANEL DISPLAY USING SAME

FIELD OF THE INVENTION

The present invention relates to key switch systems, and more particularly to a key switch system having an indicator lamp. The key switch system may be used in a flat panel display (FPD).

GENERAL BACKGROUND

FPDs are widely used in modem display devices due to their advantages such as portability, low power consumption, and low radiation. Generally, an FPD includes a key switch system. The key switch system is used to turn on and turn off the FPD.

FIG. 9 is a perspective view of a conventional FPD. The FPD 100 includes a display module 110, a supporting member 120 configured to engage with and support the display module 110, and a base 130 configured to hold the supporting member 120. The display module 110 includes a front frame 11, a display panel 12, a key switch system 13, and a back shell 14. The front frame 11 and the back shell 14 are opposite to each other, and cooperatively form an accommodating space for receiving the display panel 12. The front frame 11 surrounds a display screen of the display panel 12. The front frame 11 includes a though hole 125 disposed in a middle region of a bottom border thereof. The through hole 125 is configured to partly receive the key switch system 13.

FIG. 10 is an isometric, exploded view of the key switch system 13. The key switch system 13 includes a keycap 15, an elastic member 17, and a printed circuit board (PCB) 19. The keycap 15 includes an end wall 151, and is typically made of lightproof material. The PCB 19 includes an indicator lamp 191 and a key switch 192 thereon. The key switch 192 is electrically coupled to a controller (not shown) in the FPD 100, and is used for turning on and turning off the FPD 100. The indicator lamp 191 is configured to indicate a working status of the FPD 100.

The elastic member 17 includes a main body 171, a keycap receptacle 172, a light cover 173, and a key bar 174. The main body 171 is made of elastic material, and includes a fixing portion 179 and a free portion 170. The fixing portion 179 is configured to fix the main body 171 to the front frame 11. The keycap receptacle 172 is made of transparent resin, and includes a cylindrical sidewall 176. The cylindrical sidewall 176 defines a round groove (not labeled) for receiving the keycap 15. The keycap receptacle 172 is disposed at one side of the free portion 170, and both of the light cover 173 and the key bar 174 are disposed at an opposite side of the free portion 170. The light cover 173 is configured to prevent light beams emitted by the indicator lamp 191 from emitting upwards and causing light leakage. The key bar 174 is configured to directly press the key switch 192.

Also referring to FIG. 11, in assembly, the elastic member 17 is fixed to an inner surface of the front frame 11 via the fixing end 179, with the keycap receptacle 172 disposed in the through hole 125. The keycap 15 is engaged to and received in the round groove of the keycap receptacle 172, thereby the keycap 15 is surrounded by the cylindrical sidewall 176. The PCB 19 is moved towards the elastic member 17, so that the indicator lamp 191 is disposed below the light cover 173, and the key switch 192 contacts the key bar 174 without any pressing force.

In operation, when the FPD 100 is turned on, the keycap 15 is pressed in, and this causes the main body 171 to be elastically deformed. The key bar 174 is forced to press the key switch 192, such that the key switch 192 is switched on. Then a control signal provided by a peripheral circuit is sent to the controller via the key switch 192. Upon receiving the control signal, the controller controls the FPD 100 to start to function, and simultaneously provides a voltage signal to the indicator lamp 191. The voltage signal drives the indicator lamp 191 to emit light beams. Most of the light beams are transmitted to the keycap 15. Because the keycap 15 including the end wall 151 is made of lightproof material, the light beams are prevented from emitting from the keycap 15 through the end wall 151. Only a few light beams transmit to the sidewall 176 of the keycap receptacle 172, and then emit from an end of the sidewall 176. Thereby, a light pattern is formed, indicating that the FPD 100 is in a normal working status.

Most of the light beams provided by the indicator lamp 191 do not emit from the FPD 100. The amount of light beams that form the indicating pattern is quite limited. As a result, the indicating pattern may not be sufficiently visible or clear, and a user may not be aware of the true working status of the FPD 100. This is particularly liable to occur when the FPD 100 is used in a bright environment.

It is therefore desired to provide a key switch system that can overcome the above-described deficiencies, and an FPD employing such key switch system.

SUMMARY

In one aspect, a key switch system includes a key switch, an indicator lamp, and a light guide portion. The indicator lamp is configured for indicating a working status of the key switch, and emits light beams when the key switch is switched on. The light guide portion is configured for adjusting optical paths of the light beams. Most of the light beams emitted by the indicator lamp are converged by and reflected in the light guide portion and thereupon emit from the key switch system.

In another aspect, a flat panel display includes a display panel, a frame configured for accommodating the display panel; and a key switch system configured for controlling a working status of the display panel. The key switch system is fixed to the frame, and includes an indicator lamp and a light guide portion. The indicator lamp emits light beams when the display panel is in a normal working state. The light guide portion converges and guides the light beams to emit from of the key switch system.

Other novel features and advantages will become more apparent from the following detailed description when taken in conjunction with the accompanying drawings.

DETAILED DESCRIPTION OF PREFERRED EMBODIMENTS

Reference will now be made to the drawings to describe preferred and exemplary embodiments of the present invention in detail.

Figure 1:
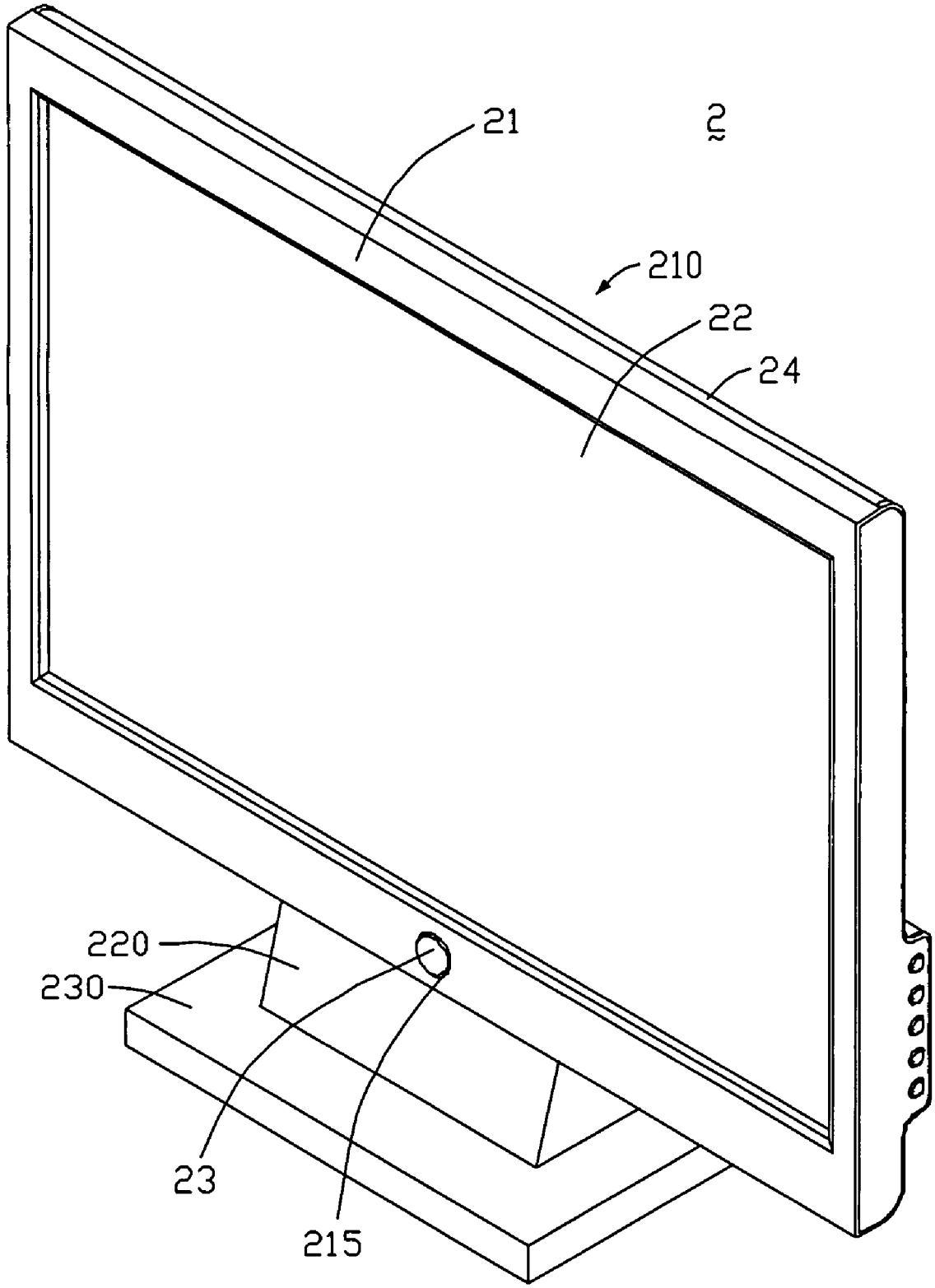
FIG. 1 is a perspective view of an FPD according to an exemplary embodiment of the present invention, the FPD including a front frame and a key switch system.

FIG. 1 is a perspective view of an FPD according to an exemplary embodiment of the present invention. The FPD 200 includes a display module 210, a supporting member 220 configured to engage with and support the display module 210, and a base 230 configured to hold the supporting member 220. The display module 210 includes a front frame 21, a display panel 22, a key switch system 23, and a back shell 24. The front frame 21 and the back shell 24 are opposite to each other, and cooperatively form an accommodating space for receiving the display panel 22. The front frame 21 surrounds a display screen of the display panel 22, and includes a through hole 215. The through hole 215 is disposed in a middle region of a bottom border of the front frame 21, and is configured to partly receive the key switch system 23.

Figure 2:
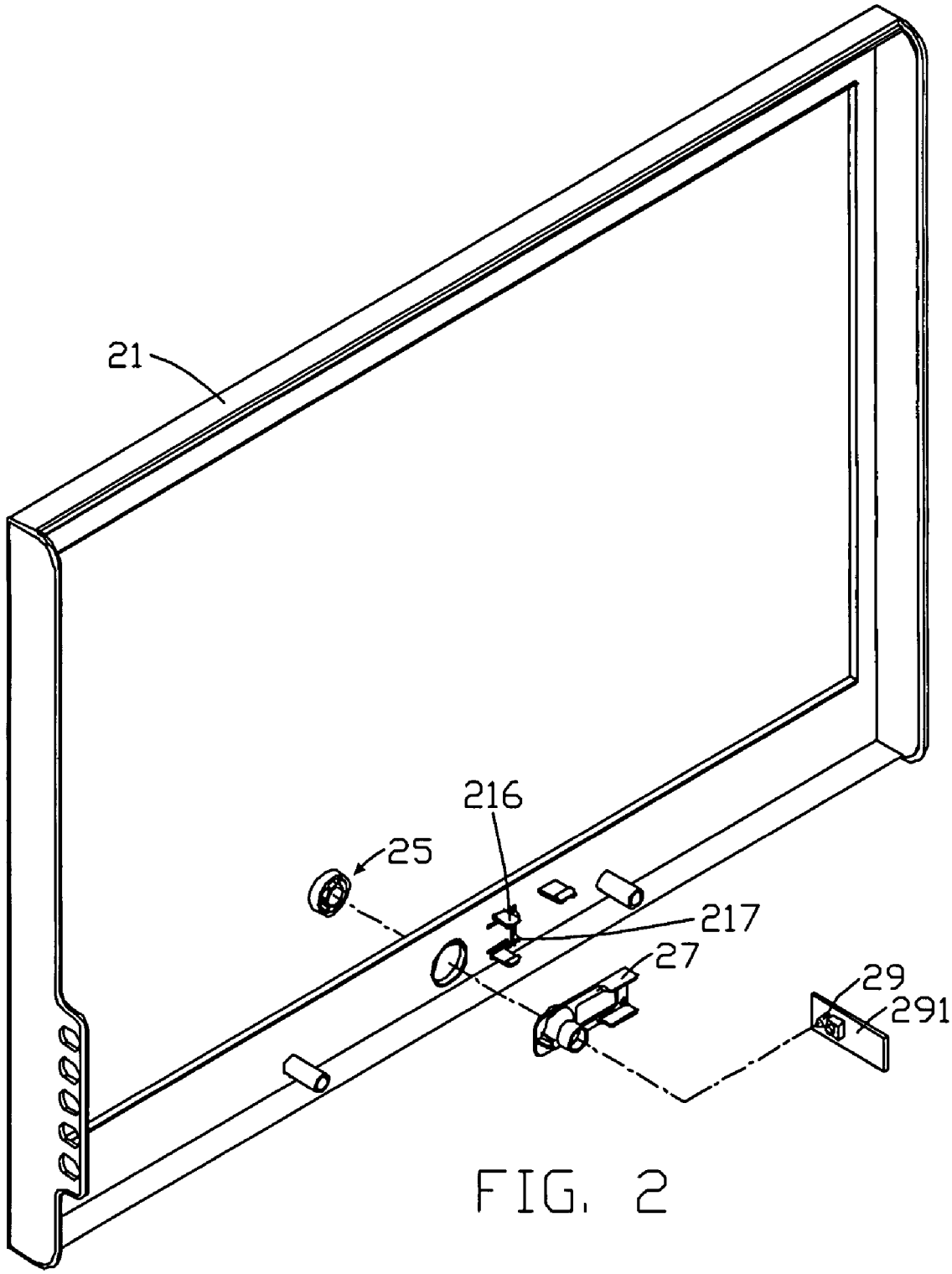
FIG. 2 is an exploded, rear view of the front frame and the key switch system of the FPD of FIG. 1, the key switch system including an elastic member.
Figure 3:
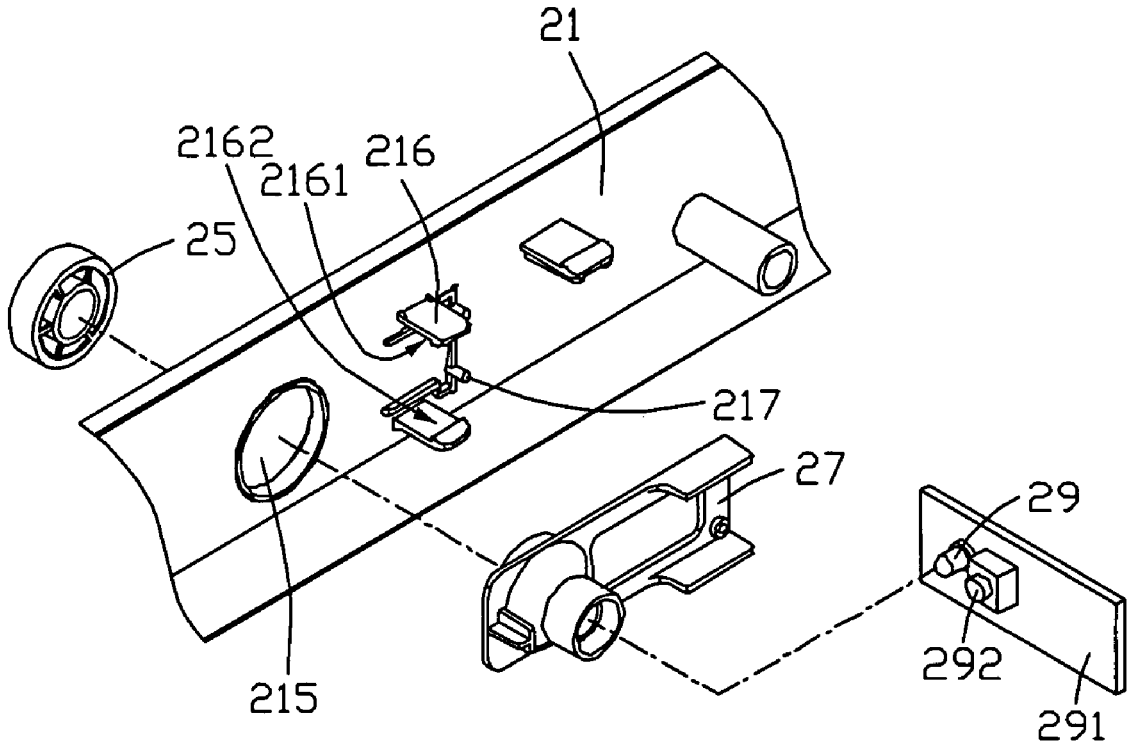
FIG. 3 is an enlarged, exploded view of the key switch system and part of the front frame shown in FIG. 2.

Referring also to FIGS. 2-3, the front frame 21 further includes a pair of fixing pieces 216 and a pair of fixing posts 217. Both the fixing pieces 216 and the fixing posts 217 extend from an inner surface of the bottom border of the front frame 21, and are configured to fix the key switch system 23 to the front frame 21. The fixing pieces 216 include an upper piece, and a lower piece opposite to the upper piece. The upper piece includes a first extending portion (not labeled) extending down from a free end thereof, so as to form a first hook 2161. The lower piece includes a second extending portion (not labeled) extending upward from a free end thereof, so as to form a second hook 2162. The fixing posts 217 are disposed adjacent to the fixing pieces 216, and arranged in a line perpendicular to the bottom border of the front frame 21.

The key switch system 23 includes a keycap 25, an elastic member 27, and a printed circuit board (PCB) 291. The keycap 25 is made of lightproof material, and has a size slightly less than that of the through hole 215 of the front frame 21. The PCB 291 includes an indicator lamp 29 and a key switch 292 mounted thereon. The key switch 292 is used for turning on and turning off the FPD 200, and is electrically coupled to a controller (not shown) in the FPD 200. The controller can for example be a scaler. The indicator lamp 29 is configured to indicate a working status of the FPD 200, and is also electrically coupled to the controller. The indicator lamp 29 can for example be a light emitting diode (LED).

Figure 4:
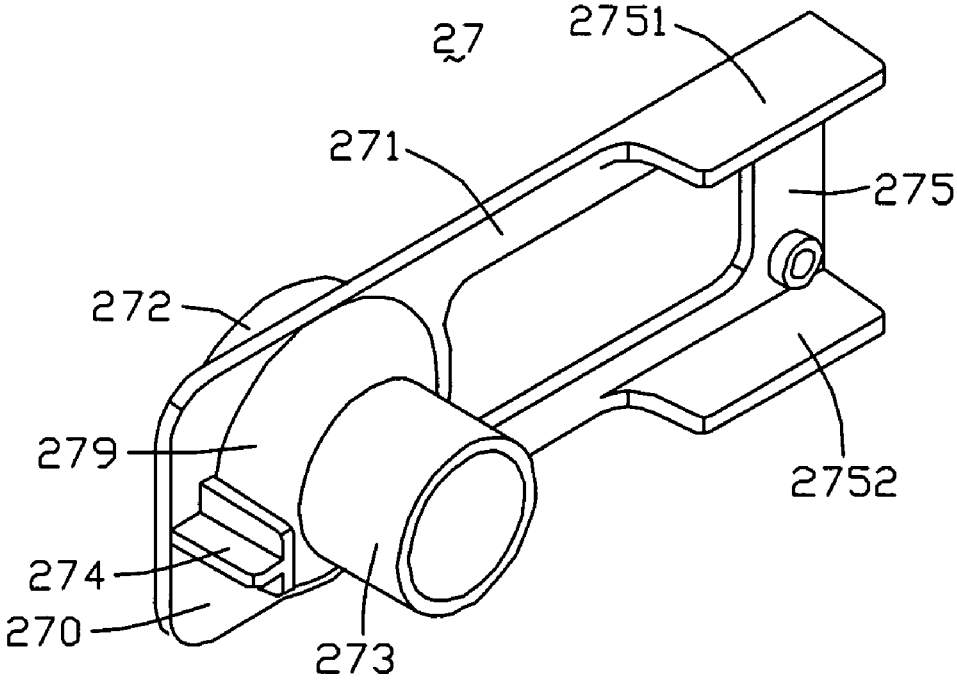
FIG. 4 is an enlarged view of the elastic member of the key switch system of FIG. 2.
Figure 5:
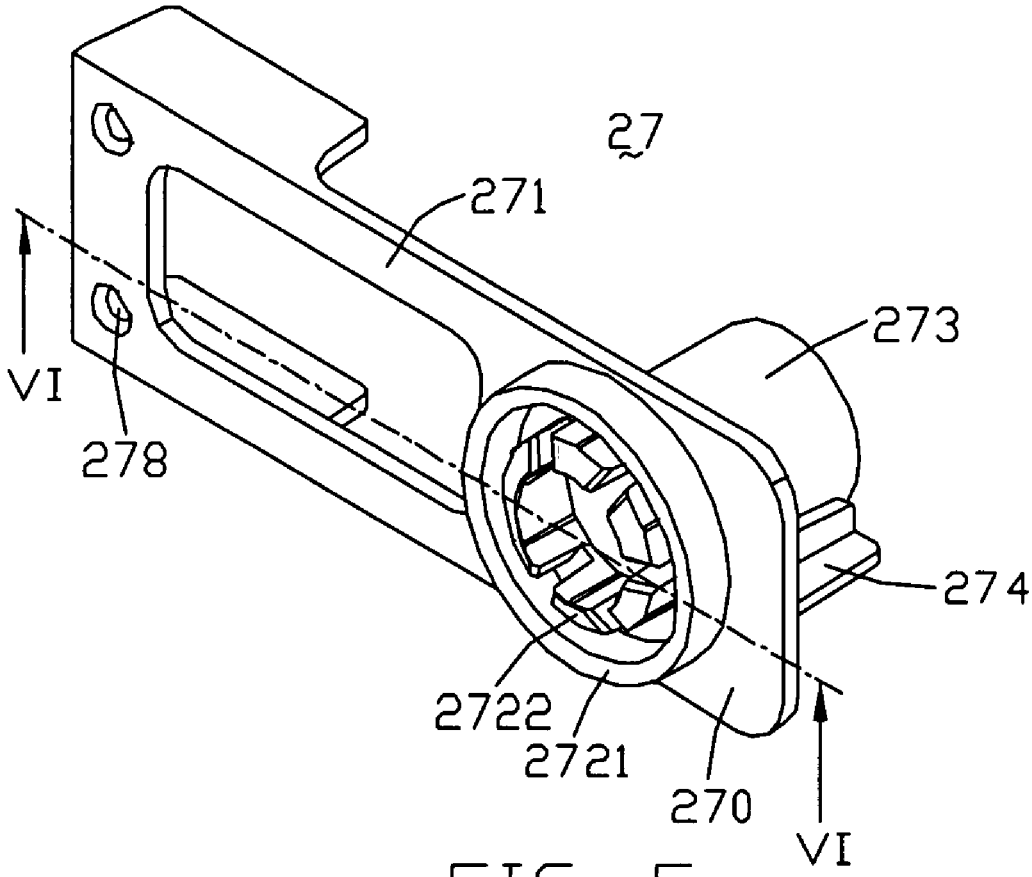
FIG. 5 is an enlarged, front perspective view of the elastic member of the key switch system of FIG. 2.
Figure 6:
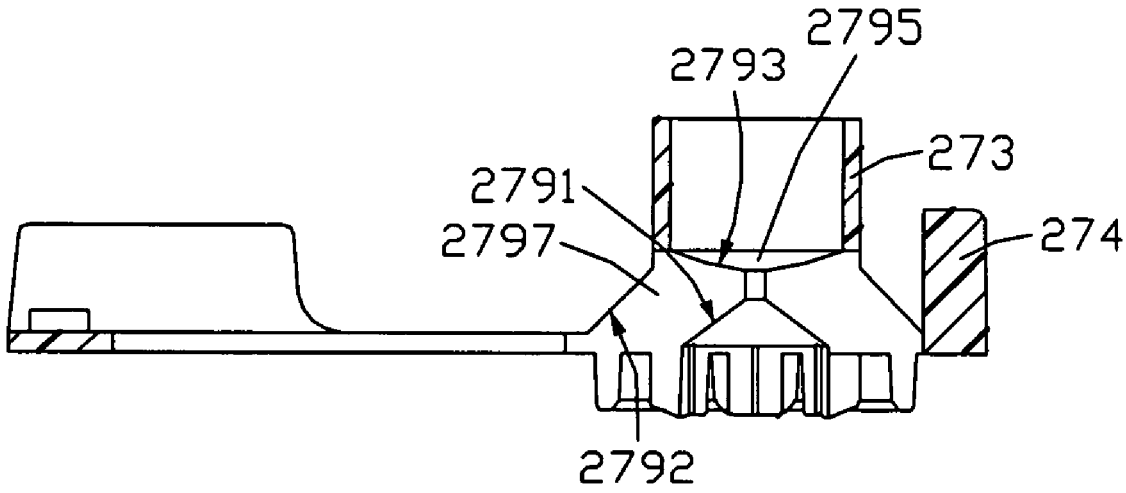
FIG. 6 is a cross-sectional view of the elastic member taken along line VI-VI of FIG. 5.

Also referring to FIGS. 4-6, the elastic member 27 includes a main body 271, a keycap receptacle 272, a light cover 273, a key bar 274, and a light guide portion 279. The main body 271 is made of elastic material, and includes a fixing portion 275 and a free portion 270. The fixing portion 275 is configured to fix the main body 271 to the front frame 21, and includes a pair of fixing holes 278, an upper protrusion 2751, and a lower protrusion 2752. The fixing holes 278 are both adjacent to an end of the fixing portion 275, and each of the fixing holes 278 corresponds to a respective fixing post 217 of the front frame 21. The upper protrusion 2751 and the lower protrusion 2752 perpendicularly extend from two opposite edges of the fixing portion 275, respectively. In particular, the upper protrusion 2751 extends from an upper edge of the fixing portion 275, and the lower protrusion 2752 extends from a lower edge of the fixing portion 275. The upper protrusion 2751 and the lower protrusion 2752 both extend from a first side of the main body 271. Moreover, the upper protrusion 2751 corresponds to the first hook 2161 of the front frame 21, and the lower protrusion 2752 corresponds to a second hook 2162 of the front frame 21.

The keycap receptacle 272, the light guide portion 279, the light cover 273 and a key bar 274 are all disposed at the free portion 270 of the main body 271. In particular, the light guide portion 279, the light cover 273 and the key bar 274 are disposed at the first side of the main body 271; and the key receiver 272 is disposed at an opposite side (defined as a second side) of the main body 271.

The keycap receptacle 272 is made of transparent resin, and includes a cylindrical sidewall 2721 and an engaging member 2722. The cylindrical sidewall 2721 defines a round groove (not labeled) therein for receiving the keycap 25. The engaging member 2722 is disposed in the round groove, and is configured to engage the keycap 25 with the key receiver 272.

The light guide portion 279 is configured to guide the light beams emitted by the indicator lamp 29 to emit from an end of the cylindrical sidewall 2721. The light guide portion 279 includes a light converging member 2795 and a light reflecting structure 2797. The light converging member 2795 is configured to converge the light beams emitted by the indicator lamp 29. In particular, the light converging member 2795 is configured to convert spreading light beams to parallel light beams. The light converging member 2795 may be a convex lens. The light reflecting structure 2797 includes a generally conical frustum-shaped portion having a hollow cone (not labeled) inside. An end surface 2793 of the light reflecting structure 2797 is shaped to be generally concave, with the light converging member 2795 being disposed in the concave region. The conic frustum structure includes a first reflecting surface 2791 and a second reflecting surface 2792. The first reflecting surface 2791 is adjacent to the hollow cone. The second reflecting surface 2792 is adjacent to an external surface of the conic frustum structure. The first reflecting surface 2791 is parallel to the second reflecting surface 2792. An acute angle $\alpha$ between the second reflecting surface 2792 and a main surface of the main body 271 is not greater than 45 degrees (i.e. $\alpha \leqq 45°$), and preferably is 45 degrees. A material of the conic frustum structure can be polymethyl methacrylate.

The light cover 273 is disposed adjacent to the end surface 2793 of the light reflecting structure 2797, and is configured to receive the indicator lamp 29. The light cover 273 has a size slightly greater than that of the indicator lamp 29, and has the shape of a hollow cylinder. A transverse cross-sectional area of an inmost end of the light cover 273 is substantially the same as a corresponding area of an end of the light guide portion 279 that connects with the light cover 273. An inner surface of the light cover 273 is coated with reflective material, so as to facilitate light utilization.

The key bar 274 is configured to directly press the key switch 292, and is disposed between an end of the free portion 275 and the light guide portion 279. The key bar 274 has a T-shaped profile, as viewed along a direction directly toward the first side of the main body 271.

Figure 7:
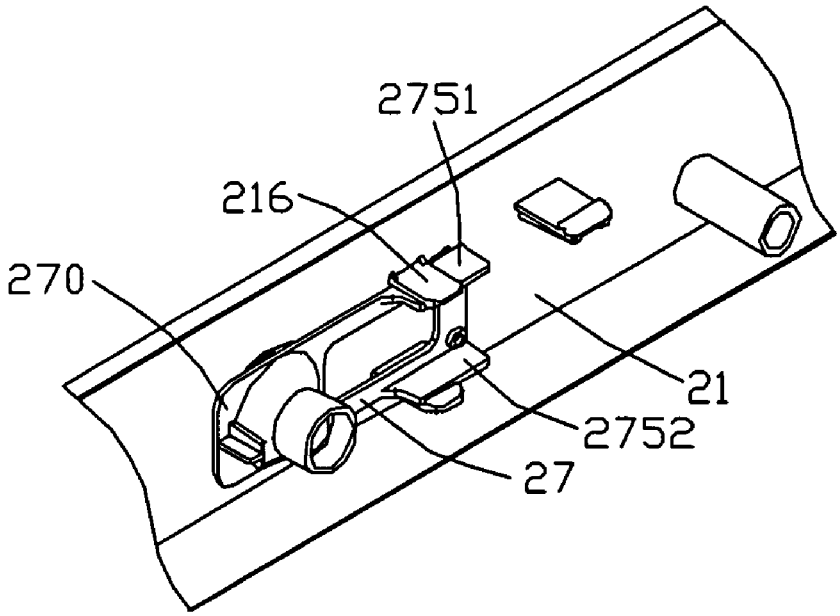
FIG. 7 is an assembled view of part of the front frame and the elastic member shown in FIG. 3.
Figure 8:
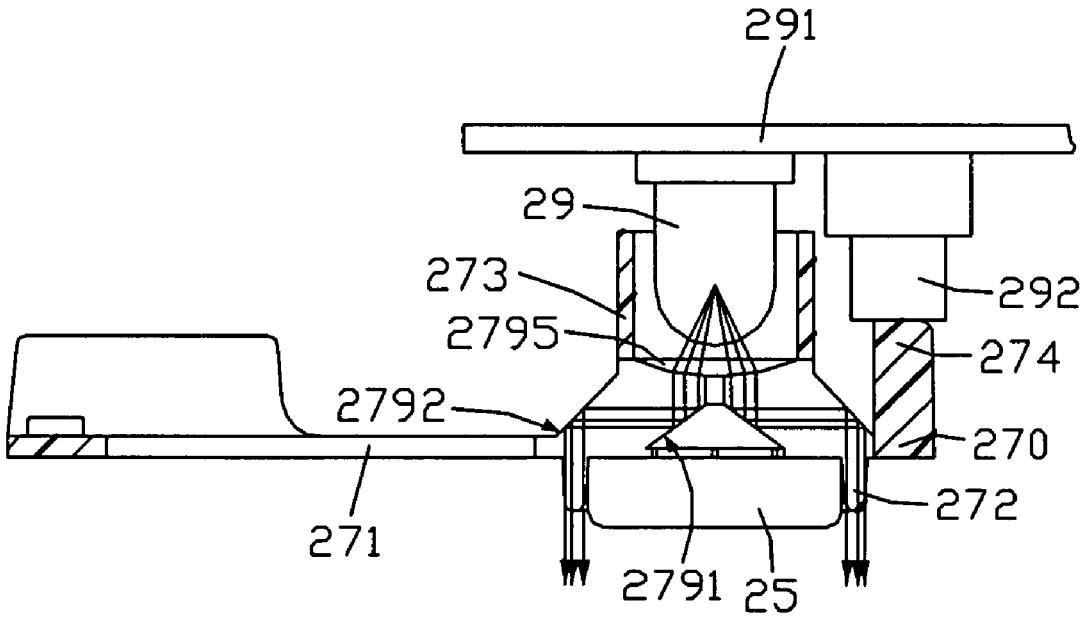
FIG. 8 is similar to FIG. 6, but showing the entire key switch system and essential optical paths thereof.
Figure 9:
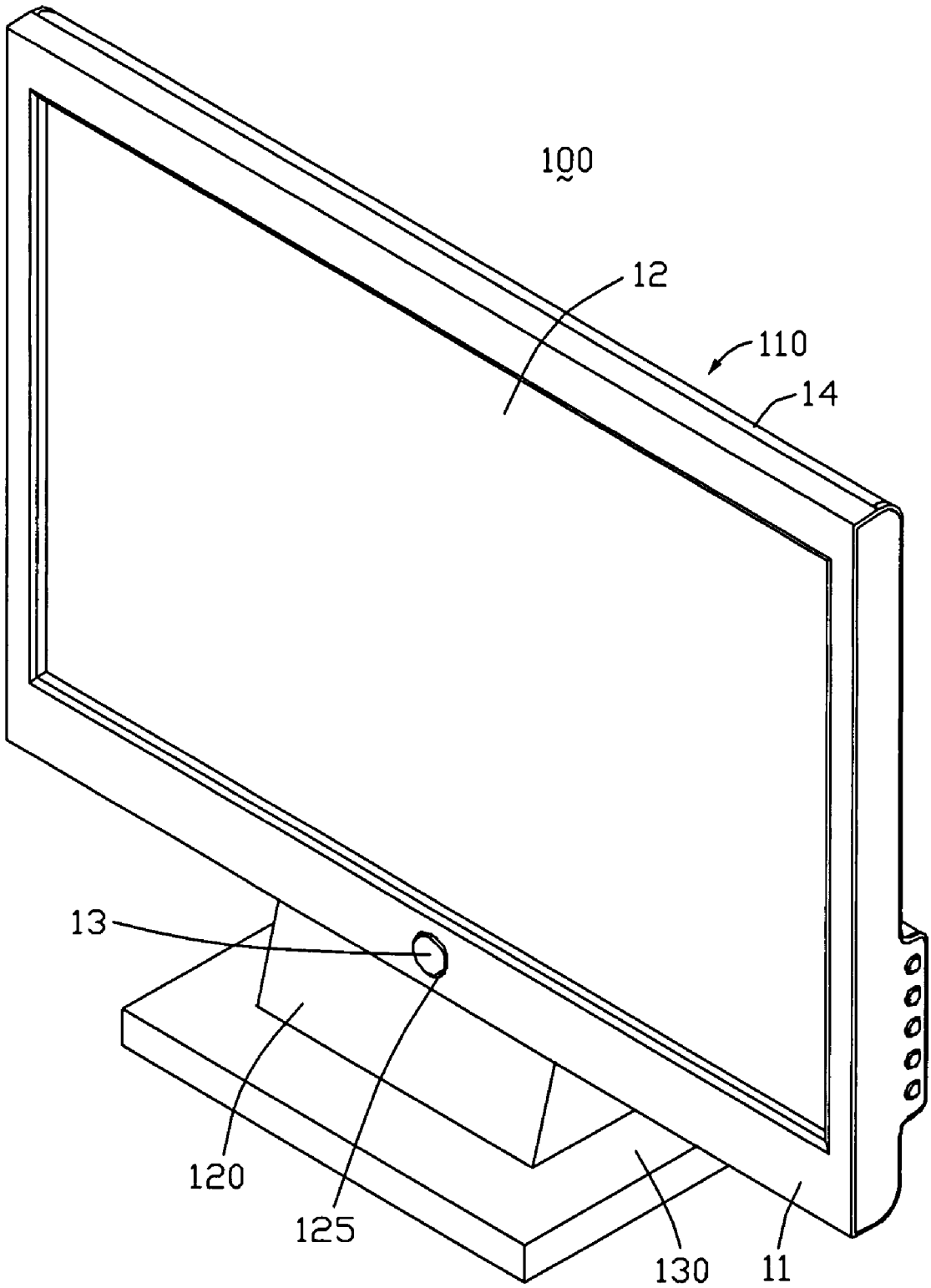
FIG. 9 (RELATED ART)
FIG. 9 is a perspective view of a conventional FPD, the FPD including a key switch system.
Figure 10:
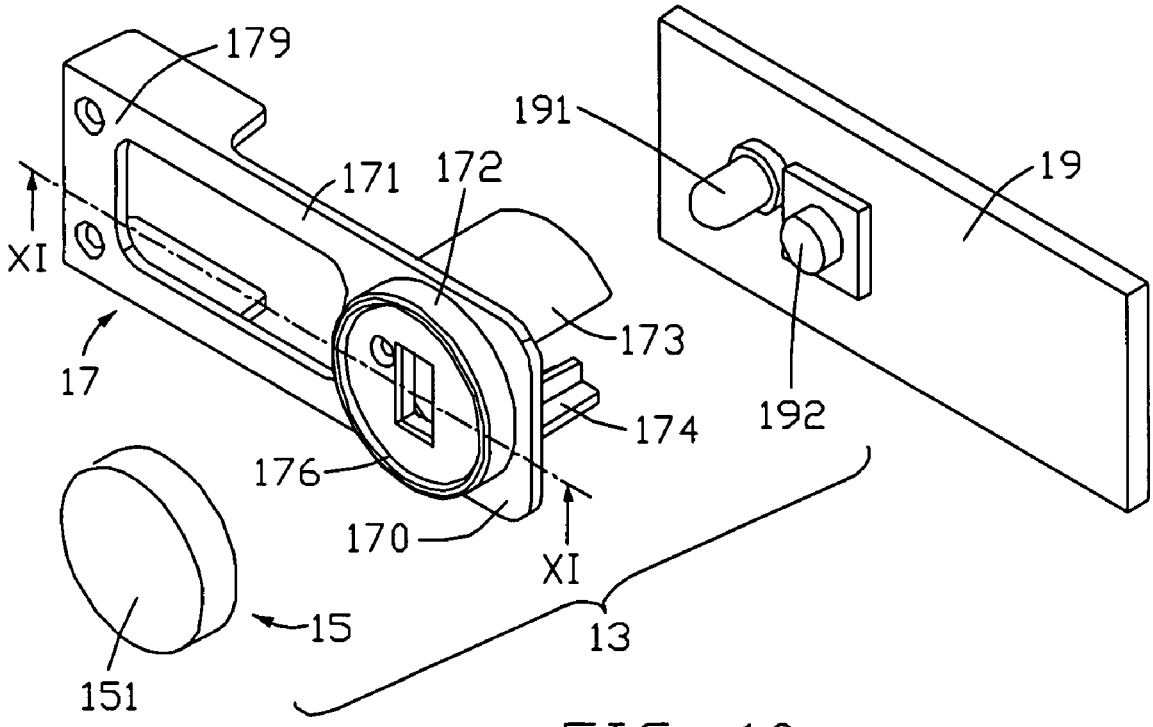
FIG. 10 (RELATED ART)
FIG. 10 is an enlarged, exploded view of the key switch system of FIG 9.
Figure 11:
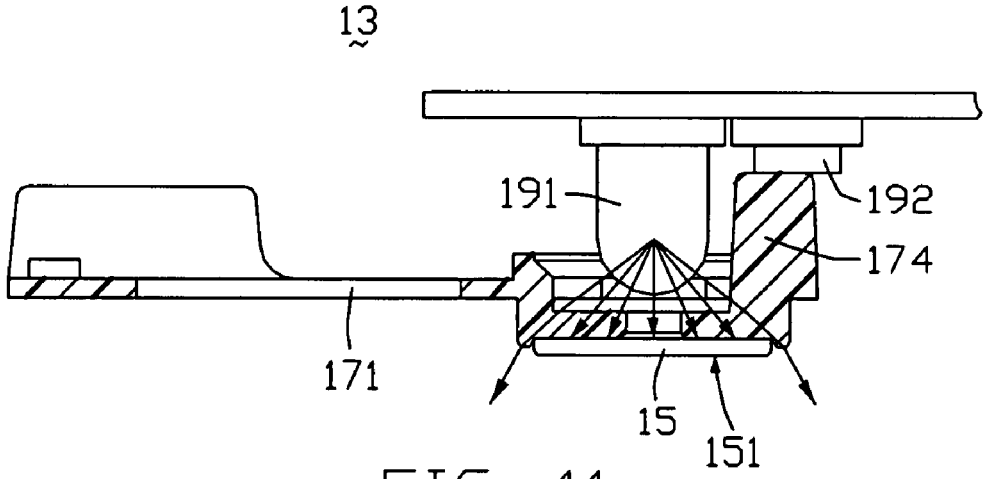
FIG. 11 (RELATED ART)
FIG. 11 is a cross-sectional view of the key switch system when fully assembled, corresponding to line XI-XI of FIG. 10, and showing essential optical paths of the key switch system.

Also referring to FIGS. 7-8, in assembly, firstly, the elastic member 27 is fixed to the inner surface of the front frame 21. Thereby, each of the fixing posts 217 is respectively received in the corresponding fixing hole 278. The upper protrusion 2751 and the lower protrusion 2752 are respectively fastened by the first hook 2161 and the second hook 2162. The keycap receptacle, 272 is inserted into and received in the through hole 215. Secondly, the keycap 25 is received in the round groove of the keycap receptacle 272, and is engaged with the keycap receptacle 272 via the engaging member 2722. Thirdly, the PCB 291 is moved towards the elastic member 27, so that the indicator lamp 29 is received in the light cover 273, and the key switch 292 contacts the key bar 274 without any pressing force.

In operation, when the FPD 200 is turned on, the keycap 25 is pressed in. This causes the main body 271 to be elastically deformed, such that the key bar 274 is forced to press and exert pressing force to the key switch 292. Thereby the key switch 292 is switched on. A control signal provided by a peripheral circuit is sent to the controller via the key switch 292. Upon receiving the control signal, the controller controls the FPD 200 to start functioning, and simultaneously provides a voltage signal to the indicator lamp 29. Then the main body 271 rebounds toward an original state, and the force exerted by the key bar 274 is removed. The voltage signal drives the indicator lamp 29 to emit light beams. Most of the light beams are transmitted to the light converging member 2795, and converged and converted into parallel light beams by the light converging member 2795. The parallel light beams enter the light guide portion 279, reach the first reflecting surface 2791, and then are reflected to the second reflecting surface 2792 by the first reflecting surface 2791. The parallel light beams are then reflected by the second reflecting surface 2792, transmitted to the cylindrical sidewall 2721 of the keycap receptacle 272, and then emit from an end of the cylindrical sidewall 2721. Thus a ring-shaped indicating pattern is formed by the parallel light beams, so as to indicate that the FPD 200 is in an on state.

When the FPD 200 is turned off, the keycap 25 is pressed down again, and the key bar 274 exerts pressing force to the key switch 292. The key switch 292 is released and switched off. Thus the control signal is cut off by the key switch 292. Without receiving the control signal, the controller controls the FPD 200 to stop working, and the controller also stops outputting the voltage signal to the indicator lamp 29. Therefore the indicator lamp 29 stops emitting light beams, and the ring-shaped indicating pattern disappears.

In the FPD 200, the light guide portion 279 is disposed adjacent to the light cover 273, and the light converging member 2795 is provided in the light guide portion 279. With this configuration, most of the light beams provided by the indicator lamp 29 are converted to parallel light beams by the light converging member 2795. The parallel light beams are reflected by the light guide portion 279 twice, and then emitted out from the end of the cylindrical sidewall 2721. Thus the optical paths of the light beams are adjusted such that few or even no light beams are transmitted to the keycap 25. Because most of the light beams emit from a region surrounding the keycap 25, the fact that the keycap 25 is lightproof does not prevent the light beams from emitting. Accordingly, an efficiency of utilization of the light beams is significantly improved. As a result, the indicating pattern is clearly visible. A user can easily recognize the current working status of the FPD 200, even when the FPD 200 is used in a bright environment.

Furthermore, the key switch system 23 can be employed in various other electronic devices, such as a computer, a printer, and the like. In alternative embodiments, the light guide portion 279 can be configured otherwise, such that the parallel light beams are reflected in the light guide portion 279 more than twice before emitting from the light guide portion 279.

It is to be further understood that even though numerous characteristics and advantages of preferred and exemplary embodiments have been set out in the foregoing description, together with details of the structures and functions of the embodiments, the disclosure is illustrative only; and that changes may be made in detail within the principles of the present invention to the full extent indicated by the broad general meaning of the terms in which the appended claims are expressed.

What is claimed is:

1. A key switch system, comprising:

a key switch;

an indicator lamp configured for indicating a working status of the key switch, the indicator lamp emitting light beams when the key switch is switched on; and a light guide portion configured for adjusting optical paths of the light beams;

wherein most of the light beams emitted by the indicator lamp are converged into substantially parallel light beams in the light guide portion before emitting from the key switch system.

2. The key switch system as claimed in claim 1, wherein the light beams are reflected in the light guide portion at least twice.

3. The key switch system as claimed in claim 1, wherein the light beams emitted by the indicator lamp are spreading light beams.

4. The key switch system as claimed in claim 3, wherein the light guide portion comprises a light converging member adjacent to the indicator lamp, and the light converging member is configured to converge the spreading light beams and convert the spreading light beams into parallel light beams.

5. The key switch system as claimed in claim 4, wherein the light converging member is a convex lens.

6. The key switch system as claimed in claim 4, wherein the light guide portion further comprises a light reflecting structure, and the light reflecting structure is configured for reflecting and thereby adjusting the optical paths of the parallel light beams.

7. The key switch system as claimed in claim 6, wherein the light reflecting structure comprises a generally conical frustum-shaped portion, and the generally conical frustum-shaped portion comprises a hollow cone inside.

8. The key switch system as claimed in claim 7, wherein an inmost end surface of the light reflecting structure is generally concave, and the light converging member is disposed in the generally concave region.

9. The key switch system as claimed in claim 7, wherein the conic frustum structure comprises a first reflecting surface and a second reflecting surface, the first reflecting surface is adjacent to the hollow cone, and the second reflecting surface is adjacent to an external surface of the conic frustum structure.

10. The key switch system as claimed in claim 9, wherein the first reflecting surface is parallel to the second reflecting surface.

11. The key switch system as claimed in claim 9, further comprising an elastic member, wherein the elastic member comprises a main body having a fixing portion and a free portion, and the light guide portion is disposed at the free portion.

12. The key switch system as claimed in claim 11, wherein an acute angle between the second reflecting surface and a main surface of the main body is less than or equal to 45 degrees.

13. The key switch system as claimed in claim 1, wherein material of the light guide portion comprises polymethyl methacrylate.

14. The key switch system as claimed in claim 11, wherein the elastic member further comprises a keycap, and a keycap receptacle configured far receiving the keycap; the keycap receptacle is disposed at one side of the main body, and the light guide portion is disposed at an opposite side of the main body.

15. The key switch system as claimed in claim 11, wherein the elastic member further comprises a light cover for receiving the indicator lamp, the light cover has the shape of a hollow cylinder, and an inner surface of the cylinder is coated with reflective material.

16. A flat panel display, comprising:

a display panel;

a frame configured for accommodating the display panel; and a key switch system configured for controlling a working status of the display panel, the key switch system being fixed to the frame, and comprising an indicator lamp and a light guide portion;

wherein the indicator lamp emits light beams when the display panel is in a normal working state, and the light guide portion converges the light beams into substantially parallel light beams and guides the light beams to emit from the key switch system.

17. The flat panel display as claimed in claim 16, wherein the light guide portion guides the parallel light beams via reflecting the parallel light beams at least twice when the parallel light beams are transmitted therein.

18. The flat panel display as claimed in claim 16, wherein the key switch system further comprises an elastic member having a main body, the main body comprises a fixing portion and a free portion, and the fixing portion is fixed to the frame.

19. The flat panel display as claimed in claim 18, wherein the fixing portion comprises at least one fixing hole, the frame comprises at least one fixing post, and the at least one fixing post is inserted into the at least one fixing hole.

20. The flat panel display as claimed in claim 19, wherein the fixing portion further comprises at least one protrusion, the frame further comprises at least one hook, and the at least protrusion is engaged to the frame by the at least one hook.

* * * * *